United States Patent [19]

Hepp

[11] Patent Number: 4,518,267

[45] Date of Patent: May 21, 1985

[54] MOBILE EVENT-MODULE

[76] Inventor: Volker Hepp, Schröderstr. 90, D6900 Heidelberg, Fed. Rep. of Germany

[21] Appl. No.: 510,229

[22] Filed: Jul. 1, 1983

Related U.S. Application Data

[63] Continuation-in-part of Ser. No. 235,894, Feb. 19, 1981, abandoned.

[30] Foreign Application Priority Data

Mar. 11, 1980 [DE] Fed. Rep. of Germany ..... 3009211

[51] Int. Cl.[3] ..... G04F 8/00; G04C 15/00

[52] U.S. Cl. ..... 368/107; 368/155; 364/569

[58] Field of Search ..... 368/10, 72–74, 368/82–84, 155–157, 107–113; 364/705, 709, 710, 569; 340/309.1, 309.4; 235/92 T

[56] References Cited

U.S. PATENT DOCUMENTS

| | | | |
|---|---|---|---|
| 4,158,285 | 6/1979 | Heinsen et al. | 368/111 X |
| 4,168,525 | 9/1979 | Russeu | 364/569 |
| 4,257,116 | 3/1981 | Asano et al. | 368/155 |
| 4,279,012 | 7/1981 | Beckedorff et al. | 340/309.4 |
| 4,283,784 | 8/1981 | Horan | 368/155 |
| 4,302,752 | 11/1981 | Weitller | 340/309.1 |
| 4,367,051 | 1/1983 | Inoue | 368/10 |
| 4,367,527 | 1/1983 | Des Jacques | 364/705 |

*Primary Examiner*—Vit W. Miska

*Attorney, Agent, or Firm*—Toren, McGeady, Stanger

[57] ABSTRACT

An event-module is, on its lowest logical level, a universal instrument for measurement and storage of times, intervals, periods, time series and durations. It permits codification of personal and external events by means of time-marks and makes them accessible in the course of their realization. It permits the possibility of analyzing the serial structure and the correlation in time of these events in a most general way. The evolution of the present can instantaneously be compared with the anticipation of the future by use of external time-marks. Further, the introduction of a programmable dialog-logic which enables the user to find answers to specific questions of, e.g., his personal experiences is disclosed. The module helps in decisions and is not only a measurement device, but also a partner. Likewise, the module can act as an opponent of the user and e.g. sophisticated games may be played. The event-module can be considered a cybernetic system into which the human being is incorporated in contrast to conventional learning machines (TURING machine, chess computer) and which interacts with his behavior patterns (habits, orderliness, etc.). This system not only records events and their duration and displays them on demand, but it interferes due to its boundary conditions ($T_e$, $\Delta T_e$) with the actual course of events. It is a mobile, interactive system with learning potential.

18 Claims, 8 Drawing Figures

MASKS M(L):

| C.T. | BIT7 $T_N$ | BIT6 $T_i$ | BIT5 $T_i$ | BIT4 $\Delta T_i$ | BIT3 $\Delta T_i$ | BIT2 $T_e$ | BIT1 $\Delta T_e$ | BIT0 UNUSED |
|---|---|---|---|---|---|---|---|---|
| 1 | 1 | 0 | 0 | 0 | 0 | 1 | 1 | X |
| 2 | 1 | 1 | 0 | 0 | 0 | 0 | 1 | X |
| 3 | 0 | 1 | 1 | 0 | 0 | 0 | 1 | X |
| 4 | 0 | 1 | 0 | 0 | 0 | 1 | 1 | X |
| 5 | 0 | 0 | 0 | 1 | 0 | 0 | 1 | X |
| 6 | 0 | 0 | 0 | 1 | 1 | 0 | 0 | X |

MOBILE EVENT-MODULE

CROSS-REFERENCE TO RELATED APPLICATIONS

This is a continuation-in-part application of U.S. application Ser. No. 235,894, filed Feb. 19, 1981, now abandoned.

FIELD OF THE INVENTION

This invention relates to an electronic device which combines the powerful hardware features of modern microelectronics with a corresponding software system for monitoring and analyzing timed counts. The device, called an event-module, in essence, comprises:

(i) a microcomputer (CPU+EPROM+RAM):
(ii) a real time clock;
(iii) a compact keyboard for input of instructions;
(iv) push buttons and hexaswitches for data;
(v) LCD displays for dialog and optionally an acoustical alarm facility for output;
(vi) an I/O interface.

BACKGROUND OF THE INVENTION

The device of the present invention is designed to operate with codified time-marks ($T_i$, $\Delta T_i$, $T_e$, $\Delta T_e$), representing absolute times and durations, which are input by the user and are interpreted and analyzed by the module. Intermediate or final results are communicated to the user in a dialog. User and device constitute a feed-back system in which both acquire the capability of learning.

The user inputs data and instructions via a keyboard and switches to the event-module. The response from the module is given on displays or acoustically and may influence the input of the user (reference is made to FIG. 1 where a dashed line represents a feed-back loop).

The specific goals of the invention essentially are:

(1) to perform a correlation analysis of objective time data of past, present and future in a very general way (synergic function of the device).
(2) to act and react on personalized events (subjective data) by interpretation of the coded input data as reflections of the user's moods, feelings, attitudes—in short, his psychic disposition ("psychotronic" function of the device).

The term "psychotronic" is introduced to describe data relevant to the user's frame of mind, but objectively realized by electronic means. When the module operates in this mode, a large scope of new applications is opened. It is, for example, possible for the user to consider the event-module as a partner who can help him to change his behavior patterns (see habit-breaking routine ADDICT, discussed later). Similarly, the module can oppose the user in games (see "STRATEGY" game, also discussed later).

For discussing the synergic function of the module, it is appropriate to compare it with present-day electronic watches:

(1) Modern digital watch with several alarms, lap and split facilities (e.g., SEIKO FW 011 Quartz Digital LC Alarm Chronograph or CITIZEN Quadrograph 41-1043).
(2) Combinations of watches with computing facilities (e.g., SEIKO FH 005 Quartz Digital LC Kalkulator or CITIZEN-Calculator 49-9714).

Electronic watches according to (1) can measure times and lapses and can give alarms. They are, however, unable to correlate whole series of times and durations and, for example, the reason why an alarm was given cannot be reproduced. Also, the non-occurrence of an alarm condition is not signalled. A detailed summary of the questions which the event-module can answer is given in table 1 and discussed below. Electronic watches according to (2) are playful gadgets, because computer and watch are separate units. The combination of both elements demonstrates, at most, the technical advance of modern LSI or VSLI technology.

In the event-module, the microprocessor with peripherals is the most essential part of the system and is needed for operations with time-marks. The computer in the module is not designed to perform independent numerical calculations, but serves for event analysis and control.

The "psychotronic" function of the event-module is appropriately discussed when comparing it to modern "intelligent machines".

They may be classified according to 3 generations:

Generation 1: conventional INPUT--(CONTROL/ANALYSIS)--OUTPUT stations, e.g., any physics or engineering system operating with real (objective) data.

Generation 2: in addition to Generation 1, implementation of learning facilities in the CONTROL/ANALYSIS sector, but still working with objective data, e.g., chess computer (data=moves) or feedback control systems (data, e.g.=temperature, light, etc.): robots.

Generation 3: same as Generation 2, except that data are interpretations of personal events (subjective data), e.g., event-module with interrogating series which reflects the impatience of the user.

Hence, a new ingredient has been put into the system: user—module: "psychotronic" data. In order to clarify this aspect, the steps in which the module operates are given explicitly:

(i) the user *interprets* his personal events via codified time-marks, hereby transforming subjective into objective data.
(ii) these objective data are input into a *conventional* hardware logic.
(iii) in the logic, programs are implemented (fixed in ROM; data are in RAM) which operate on these interpretations (subjective data), hence in a fictitious environment.
(iv) the system outputs via *conventional* hardware objective answers to subjective questions which, in turn, may influence the future inputs of the user, again only relevant in his subjective world.

Whenever the event-module operates with personalized data (events) and not as a measuring and correlating device of objective data, a proper definition of the invention is "Mobile-Programmable-Personal-Data-Analyzer with Learning Potential and Interactive Features (Dialog)". For brevity, one might just call it: "psychotronic" module.

It is noted that mobility of the module is essential for executing any task related to personalized data (direct user's access) although asynchronous data transmission to remote stations is possible.

For a better understanding of the present invention together with other and further objects thereof, reference is made to the following description and accompanying drawings while the scope of the invention is pointed out in the appended claims.

DESCRIPTION OF THE PREFERRED EMBODIMENTS

Data definition and mode of operation

In order to understand the versatility of the event-module in the various modes of operation, firstly, a proper definition of the data used by the module has to be given.

Figure 3:
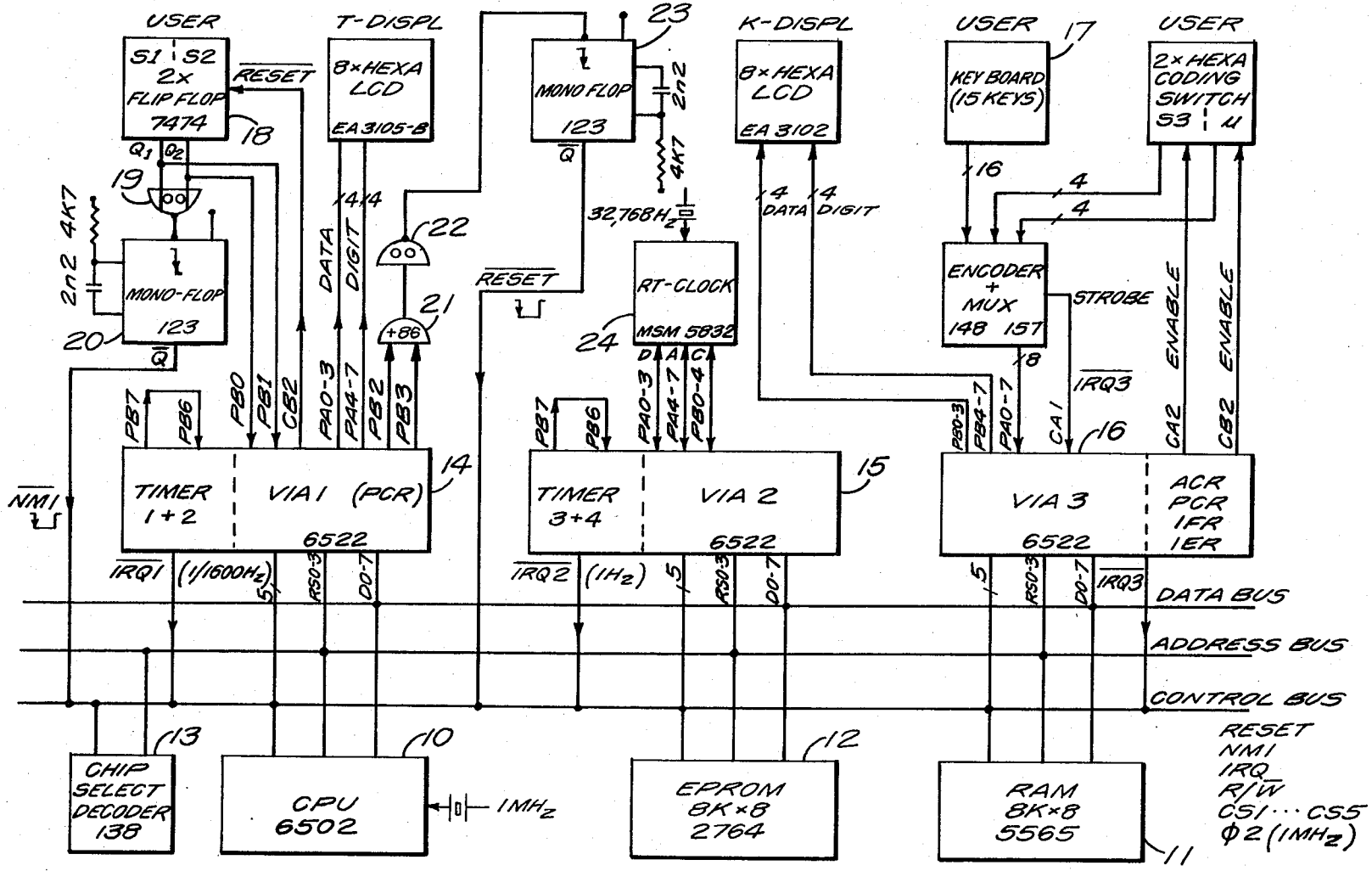
FIG. 3 is a schematic diagram in partially block representation of the hardware system architecture of the event-module.

The event-module operates with codified time-marks which are recognized, if the user presses two push-buttons S1 or S2 and has set a coding switch to a certain position (e.g., hexacoding switch U) (these switches are described with respect to FIG. 3). Whenever S1(U) is pressed, a time-mark $T_i$ (i=intern) is entered into a corresponding time series in RAM. S2(U) increments an analogous series of lapses $\Delta T_i$ with respect to $T_i$. Another kind of data, called $T_e$, $\Delta T_e$ (e=extern) is entered into the appropriate RAM fields in the module via the keyboard and the synchronization switch S3 of the RT-clock. As will be seen in the following, the time-marks which define absolute times $T_i$, $T_e$ or lapses $\Delta T_i$, $\Delta T_e$ (any type U) can be considered operands or events. Furthermore, $T_i$, $\Delta T_i$ may be interpreted as occurred (non-occurred) events of present or past, $T_e$, $\Delta T_e$ as future events or boundary values.

Another series of events which is stored internally in the module are the instants at which the module was interrogated. This series $T_{qu}$ is entered via the keyboard and is particularly useful for treatment of personalized data. Finally, there is the data furnished by the RT-clock: $T_N$: stepping normal time; $T_R$: stepping time with respect to a given switching-time and $T_{CD}$: stepping count-down time with respect to another instant.

In summary, the event-module has four *kinds* of series ($T_i$, $\Delta T_i$, $T_e$, $\Delta T_e$) of sixteen possible *types* U at its disposal, the interrogating series $T_{qu}$ and, of course, $T_N$, $T_R$, $T_{CD}$. Any member of a particular series is defined by its entry J, K, L . . . The size of the series in RAM is only limited by storage capacity.

Any series of codified time-marks ($T_i$, $\Delta T_i$, $T_e$, $\Delta T_e$) represents either occurred/non-occurred objective time data ($T_i$, $\Delta T_i$) of present or past or anticipated (future) objective time data ($T_e$, $\Delta T_e$). If the type U is associated with *personal* states or situations, (e.g., diet programs, even feelings!) this particular series represents subjective data. As mentioned before, there is an important semantic difference in the interpretation of the data. For brevity, any data, including the interrogating series, is called event in the following. Finally, it is noted that the event series may be flagged in specific applications (see: ADDICT, STRATEGY).

Then the aim of the event-module is:

(i) to perform a correlation analysis of codified series of events with respect to their occurrence or non-occurrence and their distribution in time.

(ii) to compare events of a given series among each other or with events of other kinds and types.

(iii) to allow for a dialog between user and logic in real time; and (iv) to steer the flow of occurred or expected events with programs.

All series of events are kept in the memory for any particular analysis. The analysis may be the determination of mean, variance or covariance of the distribution, or may be a therapy program or a game, etc.

A particularly important *simple* correlation between events is the *comparison* of several time operands X,Y,Z (any type or kind) in the algebraic form: $X-Y \gtrless Z$, because specific questions of the user can be answered, like:

(1) has an arbitrary event happened too early, too late, in time, too often, too seldom, earlier or later than expected, not at all?

(2) was the duration of an event too short, too long?

(3) how is the distribution of an event series in the course of time and how compatible is it with the expectations?

A summary of the six most important comparisons of events in practical applications is given in table 1. The comparisons are ordered according to the comparison type 1,,6, the logical test condition is given in column 2 and the objective (subjective) significance of the comparison is explained in columns 3–5.

The event-module is designed to answer these questions by *manual* programming with the help of the keyboard. This will be explained in the next section. In this particular mode of dialog between user and module, information on the conditions 1,,6 can be transmitted in two ways:

(i) the user wants to know whether a given condition is true or false *right now.* Such a question is reasonable for events of present and past (occurrence or non-occurrence) and *force* the module to give an *immediate* answer: YES/NO;

(ii) the user wants to be informed, when a particular condition materializes *in the future.* The module then stores the instruction and checks it regularly, by including any new entry of the event series involved in the comparison. When the condition becomes true, an answer: YES is given or an acoustical alarm sounds. This mode is a generalization of the simple alarm facility of a watch.

Two keys on the keyboard (AUTO, TRUE) are foreseen to distinguish these two modes (see next section). It is noted here that more complicated correlation analyses or other tasks (e.g., traffic control, sporting events) are implemented in the module via task routines in EPROM which are called very simply from the keyboard.

Keyboard of the event-module

Figure 2:
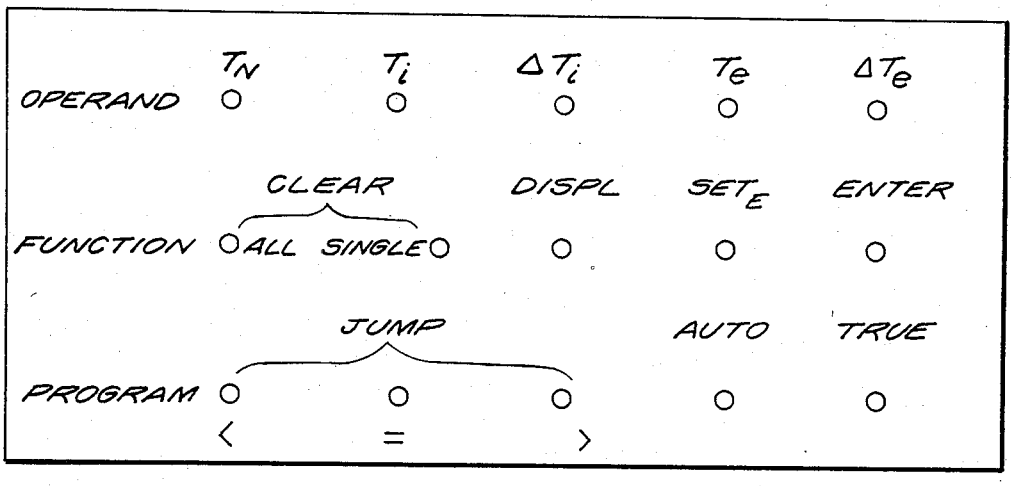
FIG. 2 illustrates a typical keyboard of the event-module.

The various modes of operation of the event-module are controlled by the keyboard which is shown in FIG. 2. Instructions for the module are entered by combined and multiple pressing of appropriate keys and summarized in table 4. A detailed description of these commands is given in the section entitled "Basic Instructions". The 15 keys are arranged according to OPERAND-, FUNCTION- and PROGRAM-keys. Any instruction has to start with a FUNCTION-key and is terminated either with an OPERAND-key or by pressing TRUE or AUTO.

The keyboard instructions are decoded in the task routine DECODE (see section concerning Interrupt routine DECODE) and are designed to give the user maximum control and flexibility in order to fully exploit the potential of the module.

The instructions can be classified according to:

(1) steering of the monitor program;
(2) manipulation of the data;
(3) I/O control;
(4) interrogation of the module ("May-I" question);
(5) manual programming of conditions;
(6) calling of specific task routines.

For clarity, three examples of keyboard instructions are given:

(a) display $2^{nd}$ entry of series $T_i$; type A:
DSP(2)--$T_i$ (set position U=$A);
(b) check, whether $3^{rd}$ entry of series ($\Delta T_i$; type=B) is smaller than $1^{st}$ entry of series ($\Delta T_e$; type=C):
ENT(3)--$\Delta T_i$($B)--ENT(1)--$\Delta T_e$($C)--JUMP<--
-TRUE note that this question corresponds to comparison type 5 in table 1;
(c) given an alarm, if the $4^{th}$ entry of ($T_i$; type=D) occurred earlier than $T_N$ by the $2^{nd}$ entry of ($\Delta T_e$; type=E):
ENT(1)--$T_N$--ENT(4)--$T_i$($D)--ENT(2)--$\Delta T_e$($E)--JUMP>- -AUTO
note that this question corresponds to comparison type 2 in table 1.

In question (a), an immediate display of the operand is given on the T-DISPL, in question (b), an immediate answer YES/NO is given on the K-DISPL and in question (c), an answer YES is given on the K-DISPL only, if $T_i$ has at least four entries and $T_N$ has incremented enough to fulfill the condition.

Applications of the event-module

In this section, some selected examples for the application of the event-module in various fields are compiled:

- Monitor of periodical duties; checking of durations or frequency of actions or states;
- Blocking of unwanted actions, therapy of habit breaking, diet, control of drug intake, daily pill;
- Registration of unusual events, e.g., traffic accident; traffic control;
- Observation of any series of appointments, control of oblivion;
- Daily or weekly backscan or overview;
- Taking care of children, animals, pets;
- Sleep control; Checklists, e.g., watchman, pilot;
- Playing games, e.g., the "STRATEGY" game;
- Observation of arbitrary event series in house, working place or sports.

Other applications are imaginable and not listed here. In the description following, it will be demonstrated in great detail, how the event-module can be realized.

Hardware Organization

Figure 1:
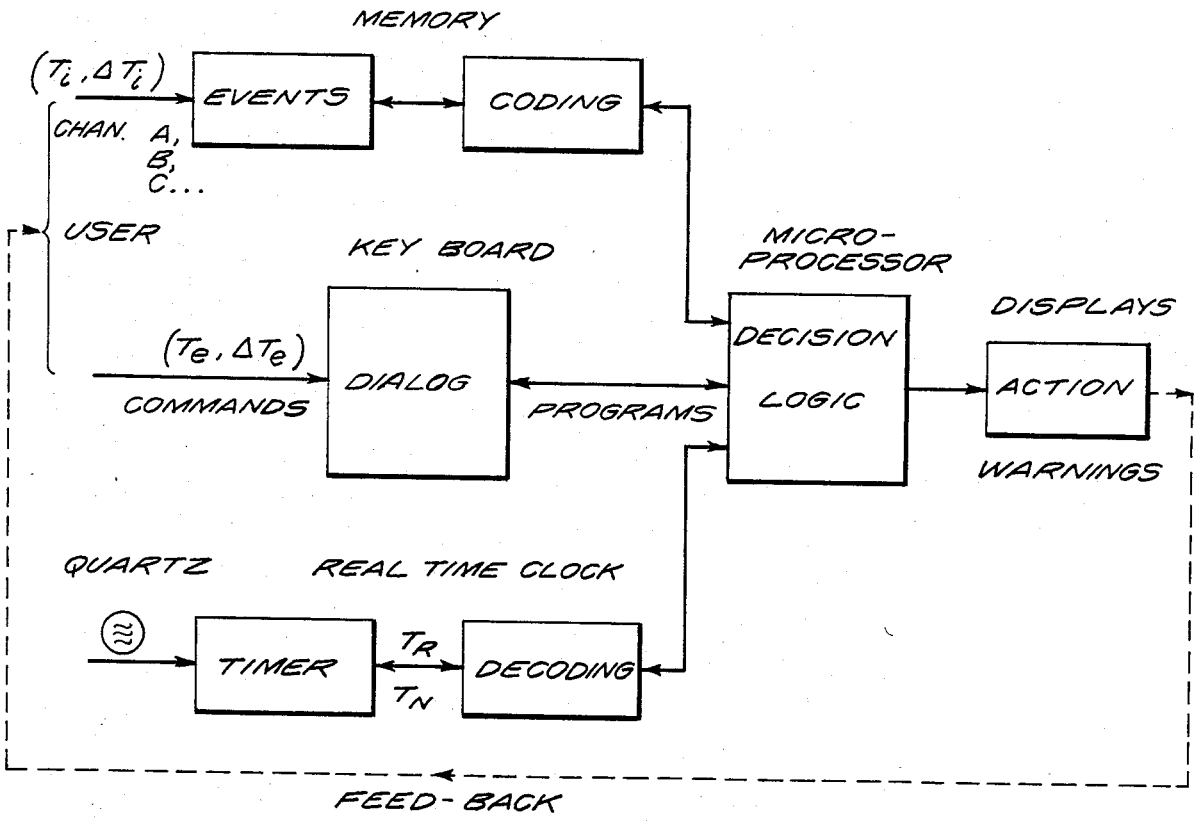
FIG. 1 illustrates in diagrammatic form the logical flow of the event-module.

The hardware architecture of the event-module in an actual setup is shown in FIG. 3 and represents a possible realization of the general logical flow diagram given in FIG. 1. It is stressed that the circuit diagram serves only as an example. In the present configuration, the actual choice of components was rather dictated by their availability and internal compatibility rather than by optimization of cost, power consumption, miniaturization and other criteria. For example, any of the components used in FIG. 3 can be replaced by a chip in CMOS technology, thereby reducing the power consumption by orders of magnitude and allowing for pile operation. Examples for replacement chips are given on the bottom of table 2.

The disclosed arrangement allows for general mobility of the event-module. Integration of the event-module into a wrist or pocket watch is achieved by well known industrial LSI or VLSI technology and will, of course, change the physical structure of the chips in a final configuration.

The system shown in FIG. 3 comprises essentially a central-processing-unit 10 (such as CPU SY 6502) linked to a 8K byte RAM 11 (such as TC 5565) for event storage and a 8K byte EPROM 12 (such as 2764) in which the monitor program, including all task routines, is kept. Addresses are decoded in the chip selection decoder 13 (such as 74LS138). I/O operations are served by three VIA ports 14, 15, 16 (such as SY 6522) which include timers, counters and latches (16 registers each). These input-output-adapters have been chosen in this example, because their versatility simplifies the otherwise somewhat more complicated circuit diagram of FIG. 3. Details on all components in the present example are found in the respective data sheets.

Although interfacing the event-module with a modern electronic watch is straightforward, in FIG. 3, a real-time clock 24 (such as MSM 5832) was incorporated in order to demonstrate a self-consistent system.

The interactive dialog of the user with the event-module is accomplished via the keyboard 17 (FIG. 2) for input of instructions (15 keys), two push-buttons S1, S2 for defining events of kind $T_i$, $\Delta T_i$, one hexacoding switch U for event-type definition (A,B,C . . .) and one hexacoding switch S3 for synchronization and for setting external time-marks $T_e$, $\Delta T_e$ (in conjunction with the $SET_E$ key). The push-buttons S1,S2 and hexaswitches S3,U may be placed at the case of the module.

For output operations, two LCD display fields are used in this example: 8 hexa LCD digits (such as EA 3102) for keyboard displays (such as K-DISPL) and 8 hexa LCD digits (such as EA 3105-B) for display of time-data derived from the RT-clock (such as T-DISPL). As noted before, the present setup constitutes only a feasible realization of the event-module. Alternative display fields or acoustical means (alarms, etc.) can, of course, be chosen and the final decision is left to the potential manufacturer.

Figure 4:
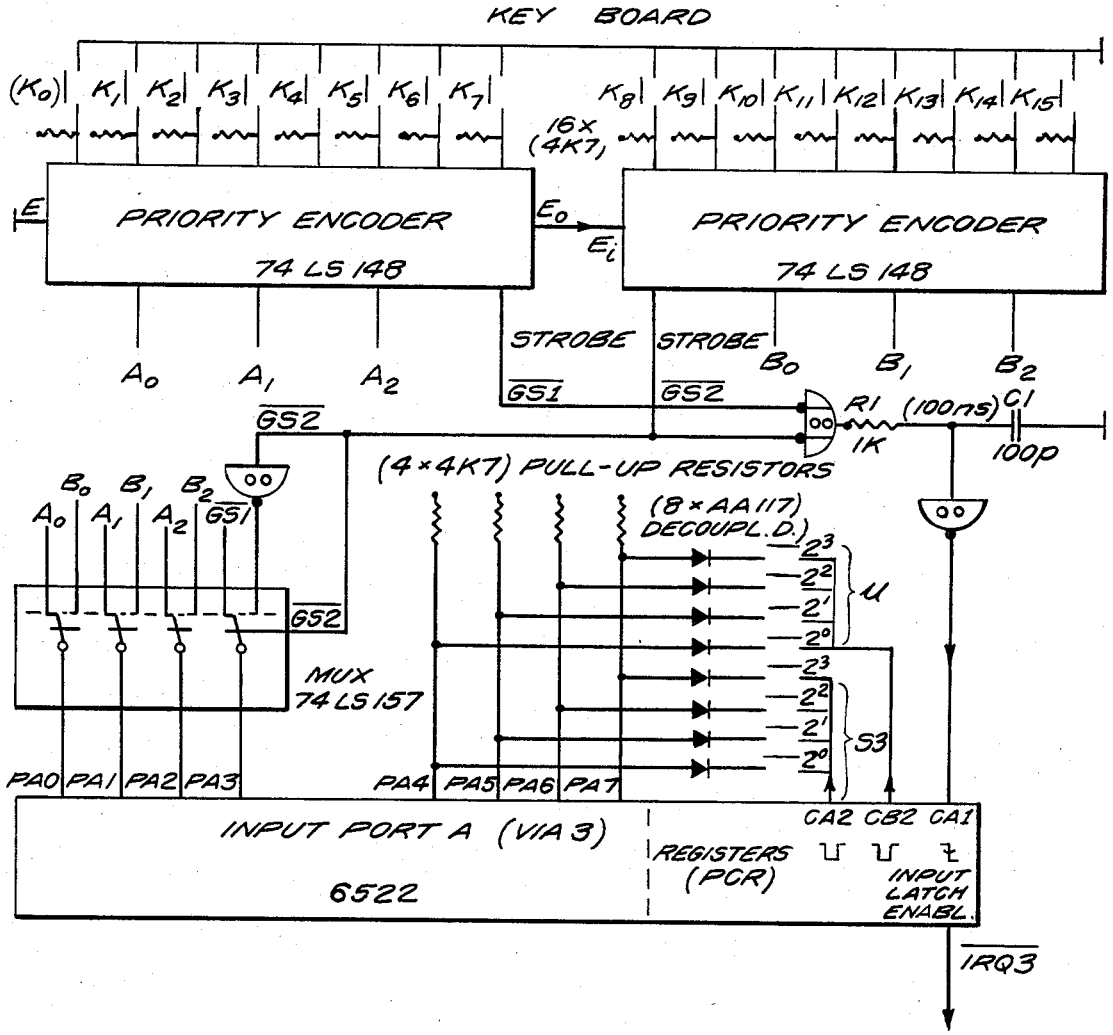
FIG. 4 represents in schematic form an encoding scheme for the keyboard and certain switch inputs.

Instructions from the keyboard and the 16 positions of S3 and U are encoded (2 priority encoders such as 74LS148), multiplexed (such as by multiplexer MUX 74LS157) and placed on the data bus via PA0–PA7 of the input port in VIA 3, element 16. An expanded view of the encoding scheme is given in FIG. 4. The pressing of any of the 15 keys results in an interrupt $\overline{IRQ3}$ in VIA 3, element 16, (IER register bit set) which is served in the appropriate IRQ-routine (see program flow chart, FIG. 5). The actual data from the keyboard is sensed by connecting the CA1 line of VIA 3 to the strobe outputs GS1, GS2 of the two priority encoders which serve the keyboard lines $K_0$–$K_7$ and $K_8$–$K_{15}$, respectively. One of the lines is not used, because only 15 keys are needed in FIG. 2. Open keys correspond to logical "1" (pull-up resistors 4K7 in FIG. 4).

If any key is pressed, either GS1 or GS2 goes down and a negative active edge on CA1 is generated. The strobes are OR'ed (such as by ¼ QUAD NAND 74LS00) and properly delayed (resistor R1 and capacitor C1) to allow for sufficient time (~100 ns) for latching the keyboard data into port A (VIA 3). The lines PA0–PA2 are used to carry the key information, PA3 is loaded with $\overline{GS1}$ or GS2, and the multiplexer is steered via $\overline{GS2}$. Hence, the data from $K_0$–$K_7$ or $K_8$–$K_{15}$ can be distinguished by the PA3 line. The CA1 negative active edge is written into the IER register of VIA 3, thus allowing the IRQ servicing routines to recognize a valid interrupt $\overline{IRQ3}$, if any of the two strobes GS1 or GS2 go low. The interrupt flag is disabled via software before return.

The 16 positions of the two hexaencoding switches S3 and U are regularly read by addressing in the monitor program the CA2 and CB2 bit in the peripheral control register of VIA 3 (set to low). Hereby, the image of S3 or U is directly placed on the PA4–PA7 port lines. Data from S3 or U is distinguishable, because either CA2 or CB2 was used in the reading cycle. No interrupt is necessary. CA2, CB2 have to be reset by writing (set to high) into the PCR (VIA 3). The data from the keyboard (lines PA0–PA3) and hexaswitches (lines PA4–Pa7) are latched in VIA 3 by setting bit0=1 in the corresponding ACR register (auxiliary control register of VIA 3).

Since input of events $T_i$, $\Delta T_i$ via S1 and S2 has the highest priority in most of the applications of the event-module, pressing of S1 or S2 is placed immediately on the system control bus as a non-maskable-interrupt ($\overline{NMI}$). The push-bottons S1,S2 are in logical "1" condition, if not pressed, by the use of two pull-up resistors 4K7 (analogous to keyboard).

The NMI-logic consists of two flip-flops 18 (such as 74LS74), a NAND gate 19 (such as 74LS00) and a mono-flop 20 (such as 74LS123) with time constant RC of ~10 μsec, to produce a negative pulse. The outputs Q1 and Q2 are OR'ed and if either one goes high, the $\overline{NMI}$ pulse is generated. The flip-flops are reset in the NMI servicing routine by writing $AO into the PCR register of VIA 1 (thus addressing CB2 in pulse mode).

A general RESET of the module is possible by instruction 3 (see table 4) from the keyboard. If this command is recognized, one of the two output lines PB2 or PB3 of VIA 1, which usually are kept low (logical "0"), is set to high (logical "1"). This conditon is in turn sensed by the exclusive OR (such as 74LS86) which then produces a high output. The following inverter 22 (such as 74LS00) produces a negative active edge at the mono-flop 23 (such as 74LS123) which gives a negative pulse ($\overline{RESET}$) of ~10 μsec. on the general control bus. The MPU recognizes this pulse at pin 40 and the monitor program in EPROM jumps to the reset vector at address $FFFC,D (see table 3). Here, the start address ($ E000) of the initialization part of the monitor is kept (see flow chart of monitor, FIG. 5).

It is noted that the NMI routine terminates with a jump to the restart address of the monitor program (see FIG. 5), because new data are present which might change the decisions of the task routines. If, on the other hand, an IRQ routine has been serviced, the corresponding IRQ flag is disabled and the monitor program continues with the next instruction (usual STACK operations implied).

The keyboard display (K-DISPL) is connected to port B in VIA 3 (output lines PB0–PB7); four lines are used for addressing the respective digits 1–8 (PB4–7) and PB0–4 transmit hexadecimal data. The monitor program keeps track of the sequence in which commands are input via the keyboard (see the Basic Instruction section and DECODE), decodes them and places them into an instruction list for later execution. Error messages or the result of an executed instruction or task can be displayed on the 8 hexa LCD digits. The outlay of the K-DISPL is explained below.

The RT-clock 24 (such as MSM 5832) is interfaced with the system by use of VIA 2 (port A and some lines from port B). This clock has thirteen internal registers for complete time information (seconds . . . years) and the data flow on PA0–PA3 (VIA 2) is bidirectional. The lines PA4–PA7 serve for addressing these thirteen registers and the control bus is placed on PB0–PB4.

The monitor program reads the real time $T_N$ regularly and keeps an updated image of the thirteen registers (such as MSM 5832) in thirteen well defined RAM locations. If desired by keyboard instruction, $T_N$ can be displayed on the T-DISPL (8 hexa LCD digits in this example) which are connected to the PA0–PA7 lines of VIA 1. The grouping of these output lines into four data and four address lines is similar to PB0–PB7 of VIA 3 which serves the K-DISPL. Since any RAM location can be placed on the PA0–PA7 bus of VIA 1, also $T_R$ (relative time, derived from software) or a selected countdown time $T_{CD}$ can be displayed.

Storage of event information ($T_i$, $\Delta T_i$; type U) into the assigned data fields in RAM is accomplished by pressing S1 or S2, interrogating the position of U and reading $T_N$ directly from the updated image in RAM.

For synchronization of the RT-clock (S3 only) or for setting external time-marks ($T_e$, $\Delta T_e$; type U), which is controlled by the keyboard instruction sequence: $SET_E$--S3--Op, an interrupt $\overline{IRQ2}$ with about 1 Hz frequency is generated. Hereby, selected time-digits in the T-DISPL can be slowly stepped, until any desired value is reached. To this end, the two internal timers T3 and T4 in VIA 2 are connected on the PB7–PB6 pins. T3 operates in the "one shot mode" and T4 in the "pulse counting mode", if one sets: bit7=1, bit6=0 in the auxiliary control register (VIA 2). The low and high order counters of T3 are loaded with $FF which produces a negative pulse on PB7 every 65.536 ms. By writing $00, $OE into the corresponding counters of T4, the interrupt flag is set at "time out" (bit 5 of the IFR and IER registers in VIA 2) and can be serviced in the monitor program.

In the synchronization mode, the contents of $T_N$ in RAM are copied to $T_N'$ (also 13 cells), $T_N'$ is incremented cell by cell in 1 Hz steps by the use of $\overline{IRQ2}$, and the corresponding digit is shown on the T-DISPL, until the user is content and switches via S3 to the next $T_N'$ cell. Position 14 of S3 signalizes: "sync. terminated" and in this mode $T_N$ in RAM and all 13 RT-clock registers are overwritten by $T_N'$.

In the mode of setting external time-marks, the content of $T_N'$ is written into the assigned RAM data field for $T_e$, $\Delta T_e$; type U, but $T_N$ in RAM and the clock registers are of course not touched.

The two internal timers T1 and T2 in VIA 1 are operated in the same way as T3, T4 in VIA 3, except that the pulse counter of timer 2 is decremented to zero after ~10 mins. (T2 is loaded with $23, $C2). The corresponding interrupt IRQ1 is used for turning-off the K-DISPL ($ 00000000), if the user has failed to do it via CLS--$T_N$ (see Basic Instructions section).

In Table 2, the system components and manufacturers are summarized. The control functions on the system control bus are indicated also in FIG. 3. The address map of the hardware system (RAM/EPROM memory configuration) is displayed in table 3.

Finally, it is noted that the system can be set up and tested by linking the general bus to e.g. an AIM 65-Single Board Eval. System (Rockwell).

BASIC INSTRUCTIONS

In table 4, a representative list of keyboard instructions is summarized and their significance is explained. At the bottom of the table, the operation mode of the two push-buttons S1, S2 and the two hexacoding switches S3, U is also given. Obviously, the actual number of keyboard commands can be largely increased or reduced according to the manufacturer's intentions for the application. The naming and actual number of keys, including their layout can, of course, also be changed. The display actions K1,,K7 and T1,,T4 are explained in the next section. It is noted here that a T-DISPL is given automatically during synchronization (T3). The K-DISPL is addressed directly by the module, if a comparison which is programmed via instruction 19 materializes (K5), or if a task routine has encountered a display condition (K6), e.g., in DECODE, ADDICT or STRAT. Completion of a manually programmed condition may also automatically be shown (K7).

Instructions 1–16 and event defining commands 20–23 are executed immediately and are kept in a task array which is defined in RAM and contains the absolute address of the OP-code in EPROM and, if necessary, absolute addresses of operands in RAM (see flow chart of monitor program). Instructions 17–19 are kept in a variable instruction list and are executed by placing consecutively each instruction block into the absolute address of the current instruction in RAM. A request is closed, if an answer was given *and* the K-DISPL was reset. This requirement enables the user to keep several AUTO requests simultaneously in the waiting queue and to check each materialization of conditions individually.

The current instruction is executed by the monitor program via an indirect jump command to the corresponding EPROM task routine. The instruction list contains essentially the information:

(i) absolute address of task routine in EPROM (OP-code);
(ii) absolute addresses of operands in RAM (instruction 18, 19);
(iii) absolute addresses of K-DISPL data bytes (instruction 17)
(iv) question number (QN), external command type (CT) and data type (U) (instruction 18, 19);
(V) REQUEST-CLOSED FLAG;
(vi) RESULT flag, including YES/NO bit.

The OP-code and addresses of eventual operands, the question number and command-, data-type are evaluated in DECODE (see flow chart). The K-DISPL data is filled by the corresponding task routines (see ADDICT, etc.), the RESULT flag is set, if a subroutine returns with a final answer and the monitor switches the REQUEST-CLOSED flag, if the particular task or request is terminated.

In manually programmed correlations (instruction 18, 19), a TRUE request is always put on top of the list (QN=0), whereas AUTO questions are entered according to their input time. The command type CT is set to the comparison type 1,,6 (see table 1) for mnemonic reasons. The display of QN, CT, U and YES/NO (K5, K6) constitutes valuable information for the user, because he can easily trace back which AUTO task he had requested. By definition, an AUTO question gives only a YES answer, if the condition becomes true, which might be very much later than the input of the request.

In case of special task routines (ENT(n)--AUTO), the command type is a number between $7 and $F.

Outlay of display fields (K-DISPL and T-DISPL)

Table 5 summarizes the information displayed on the 8 digits of the K-DISPL (K1,,K7) and of the T-DISPL (T1,,T4). In the present setup, only 8 digits for the T-DISPL have been foreseen, although the RT-clock (such as MSM 5832) has 13 registers and three bytes in RAM are reserved for each event series. Also, since $\Delta T_i$ is evaluated via software, fractions of seconds can be handled in principle. But in the present hardware example, emphasis was put on displaying personalized events which occur on a daily scale. The final choice of displaying times will depend on the application of the module anyway.

Most of the displays are straightforward and further comment is unnecessary. For example, the K7-display is useful for checking the setting up of a manually programmed instruction. The K2 and T2 displays serve mainly for control of personalized data, because they can be considered *indirect* "May-I" questions, in contrast to ENT--TRUE. It is noted that the user can also avoid the "May-I" question by direct manual programming of instruction 18. Hence, the display features K2, K3 and T2 enlarge the scope of any May-I game or serious therapy.

Flow chart of the monitor program

Figure 5:
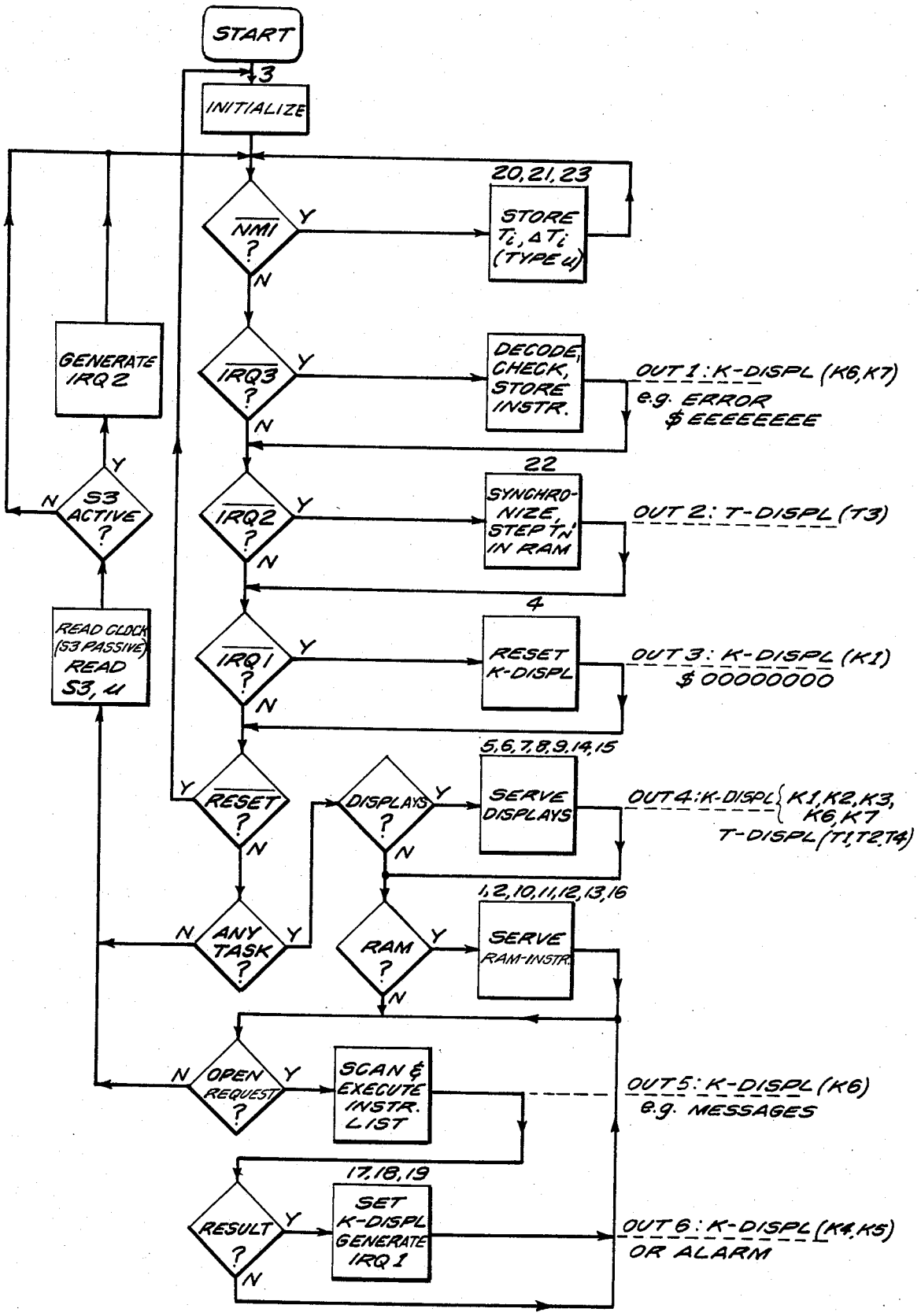
FIG. 5 represents a flow chart of a monitor program.

In the description of the hardware architecture described above, many features of the monitor program have been outlined. The flow diagram, as shown in FIG. 5, exhibits the basic strategy of the program which consists essentially of the following steps:

(i) response to hardware interrupts, in particular, input of events (NMI routine) and keyboard instructions (IRQ3);
(ii) decoding and storage of events and instructions and setting up of an instruction list;
(iii) servicing of task routines and communication with the user via the two display fields;
(iv) updating of $T_N$ in storage.

As explained before, the branching of the monitor to the NMI-vector (see address map) can happen anywhere in the program, hence, the corresponding box in the flow chart has obviously only a symbolic meaning. If an NMI condition occurs, the monitor program returns to the restart address, if a RESET is recognized from the keyboard, a jump to the initialization phase is performed (see the description in the Hardware Section).

On the right-hand side of the flow diagram, six typical outputs of the program (OUT1--OUT6) are indicated. The numbers (1 . . . 23) on top of the boxes in the chart correspond to the 23 basic instructions which had been discussed in the Basic Instructions section.

It is again pointed out that hardware and software as described here serve only as examples of how an event-module can be realized with present know-how. If a potential manufacturer chooses a different hardware solution, the software will also very probably be different from this example.

Nonetheless, some basic requirements have to be met in the outlay of the monitor program in the event-module, irrespective of any electronic detail which is introduced into the system:

(1) the program has to build up a variable instruction list according to the various requests which the user communicates to the module. Each instruction corresponds to a specific task and may be a simple hardware control function or a complicated subroutine. Space for bookkeeping has, in general, to be provided (see address map).

(2) apart from the simple I/O interfacing commands (see Basic Instructions section), *manual* programming of conditions (instructions 18 and 19) corresponding to the command types in table 1 has to be recognized by the program (decoding of keyboard sequence). According to the choice (TRUE or AUTO), the answer has to be given either immediately (YES/NO) or, in case of its eventual materialization (YES). These programmable conditions involve inequalities with two or three operands which belong to whole series of events defined by their type or kind.

(3) any complicated correlation analysis of event series (see instruction 17: ENTER (p times)--AUTO) has to be programmed and to be fixed in the corresponding task routine (p) in the EPROM. This analysis can be related either to *objective* data (e.g., traffic control) or *subjective* data, defined by the user himself (see example: addiction therapy). Typical for subjective data is an event in the interrogating series, because these entries are a "measure" of the subjective feeling of impatience.

It is the interactive treatment of subjective data, as stated repeatedly, that distinguishes the event-module from conventional measurement and analysis devices. The user oriented task routine in the event-module operates with interpretations of data (personal events), hence, in a fictitious environment, although I/O, analysis and controls are performed by *conventional* means. The learning potential of the module, if properly used, is therefore different from the learning strategies built into the present generation of "intelliget machines". Even the most sophisticated chess computer, for example, operates with "moves", hence, objective data.

For illustration of this important aspect of data interpretation, in the following section two representative task routines of the event-module are outlined which either use objective data (example: keyboard decoding) or subjective data (example: habit breaking).

Representative examples for task routines (1) Interrupt routine DECODE

Figure 6:
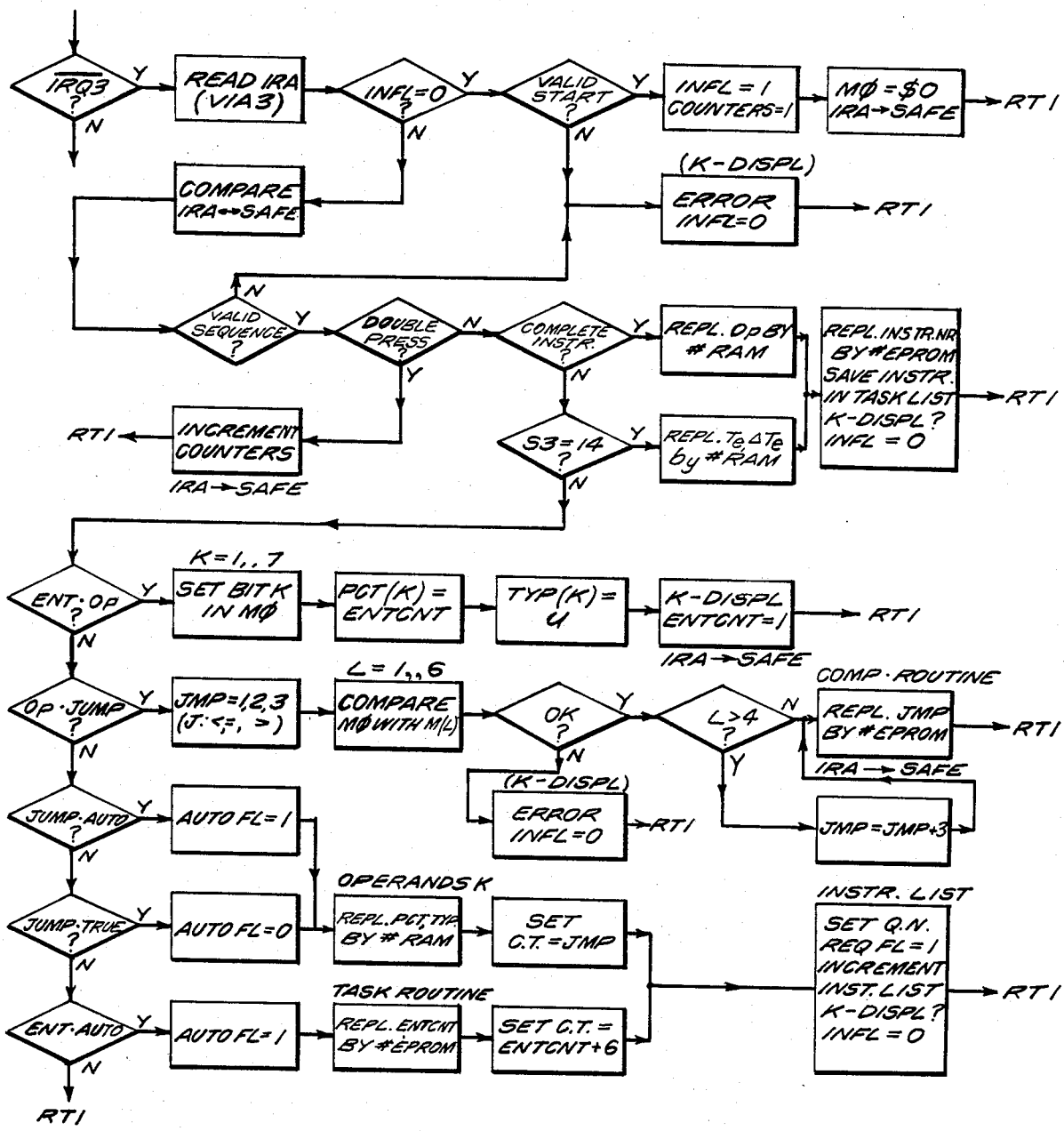
FIGS. 6–8 are examples for specific task routines.

In an earlier section, the basic instructions which can be entred into the event-module have been described. The flow chart shown in FIG. 6 outlines the structure of the decoding routine DECODE which recognizes interrupts IRQ3, caused by pressing any key of the keyboard, and converts them into executable instructions.

Keyboard commands always involve pressing of at least two keys and are initialized by activating a key of the FUNCTION row in FIG. 2 (CL, CLS, DSP, $SET_E$, ENT). Multiple pressing of the same key defines either the entry of an operand of a given series or a particular task routine to be executed (ENT (n times)--AUTO). These operations are easily recognized by appropriate flags and counters, e.g., ENTCNT for counting ENT. The flag INFL distinguishes between entering DECODE at the beginning of an instruction (INFL=0) or in-between a sequence (INFL=1). In the latter case, the previous content of the keyboard lines is kept in SAFE, in order to separate multiple pressing of the same key from valid instruction fragments.

Any user error is signalled on the K-DISPL and the instruction is declared invalid. It is noted that the keyboard display may also be activated automatically for displaying the number of pressing a key associated with an operand of given type and kind or with a task routine. This feature is valuable for control when an instruction is set up.

Simple "2 key commands" for RAM, K-DISPL and T-DISPL operations are kept in a task list. Synchronization has to be terminated (S3=14) before an external time-mark $T_e$, $\Delta T_e$ can be entered into the assigned RAM field.

Decoding of inequalities which involve two or three operands is shown in the lower part of the flow diagram. The six different types of comparison (command type CT=1,,6; see table 1) are decoded by use of six masks M(1),,M(6) which represent the bit pattern of the operand kind and are summarized below FIG. 6 The user's choice of kind is written into the mask MO, the selected event type and entry of the particular series is stored in TYP(K), PCT(K). If MO is found to be valid, the absolute RAM locations of the arguments are obtained from TYP, PCT and the absolute EPROM address of the comparison routine is derived from JMP. Obviously, only six types of comparisons are possible, namely: "branch on smaller, equal or bigger" and two or three operands. If $T_N$ is involved in the comparison (bit7=1 in MO), the current value of $T_N$ is obtained from the 13 assigned RAM cells, converted into seconds and kept in three bytes, as mentioned before.

The necessary absolute addresses for execution of commands (OP-code and arguments) are kept in the variable instruction list, together with appropriate flags and identifiers (see Basic Instructions section). The command: ENT--AUTO does not need an operand explicitly in the calling sequence. The start address for the particular task routine is directly evaluated from ENTCNT and the command type CT for K-DISPL is set to ENTCNT+6.

More examples of task routines can be given which correlate objective time data and optimize specific goals (e.g., traffic control and analysis). However, coding of such routines is straightforward and is omitted here. Also, feedback systems using objective data and employing learning strategies are not discussed, because this particular aspect is treated in great detail in the examples ADDICT and STRAT (see the following sections).

(2) Task routine ADDICT

How the event-module can be applied in the treatment of personalized (subjective) data ("psychotronic" function of the device) will now be demonstrated. Furthermore, it is explicitly shown how learning strategies can be handled in practice. This latter feature is extremely important in the field of habit breaking (ADDICT) or e.g., games (see "STRATEGY" game, described in the next section).

Clearly, alcoholism, drug-addiction, obesity and abuse of smoking, etc. belong to the most severe problems of modern civilization. The task routine ADDICT shows, in the example of smoking, how a habit-breaking therapy can be performed with the event-module and how the behavior patterns of the user can be changed (learning facility).

Figure 7:
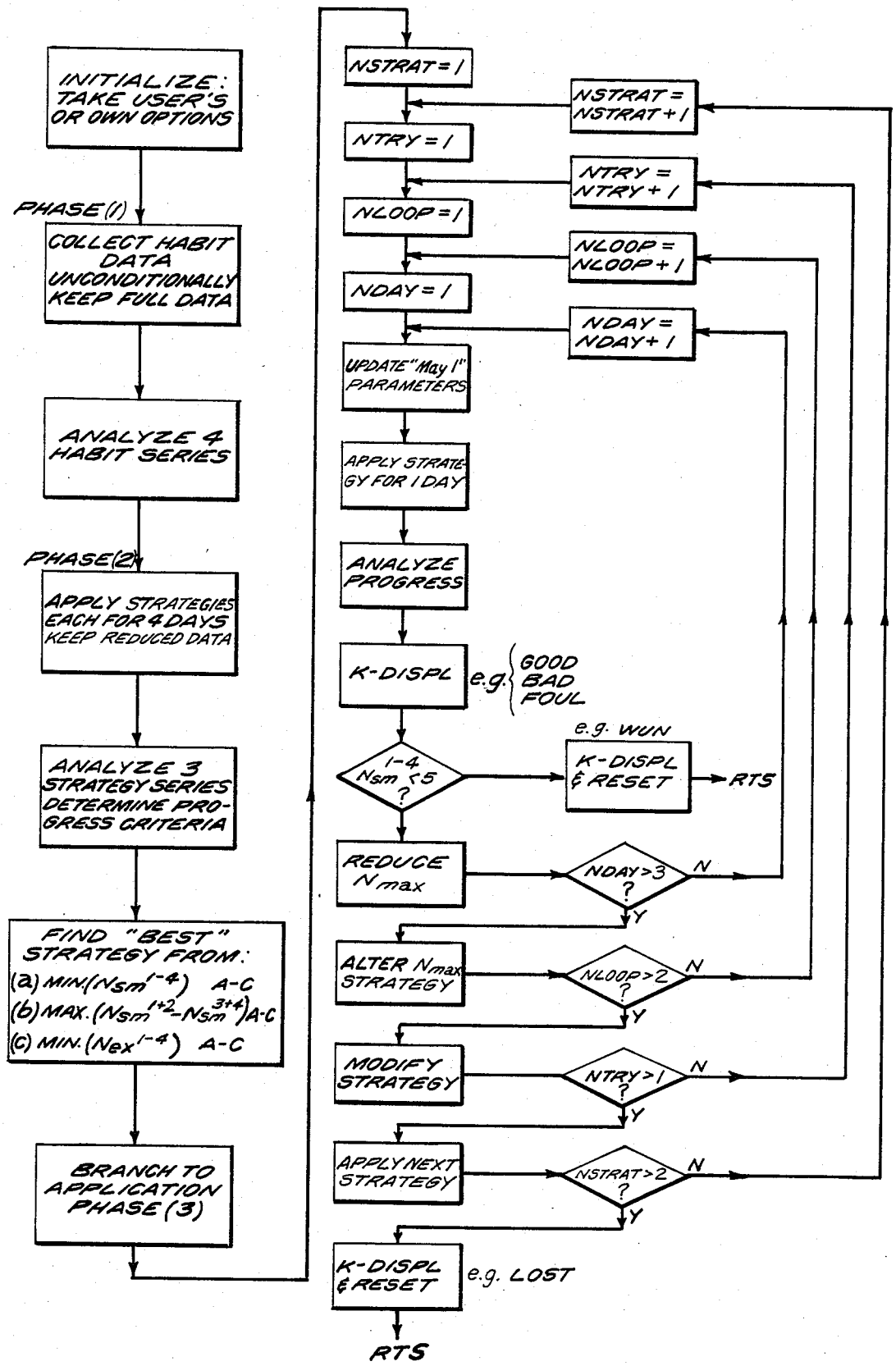

Obviously, programs with learning power are usually complicated, however, they are straightforward to code, as soon as the functional requirements of the system are completely specified. In the following, emphasis is put on outlining as clearly as possible the logical structure of the programs. The general flow chart of the task routine ADDICT is shown in FIG. 7 and three representative examples of strategies which may be used by ADDICT are fully decoded in FIG. 8. It is to be noted that the memory space requirements for executing the routine ADDICT are met in the present RAM/EPROM configuration.

Before going into the details of the program, some general remarks are in order. First of all, learning implies exchange of information and adaptation to new situations or requirements in the environment. As will be seen, the event-module possesses these characteristics. Secondly, the event-module interprets data given to it from outside. The input data flow therefore depends very much on the user's intention, either to communicate earnestly with the module (e.g., by following the rules of properly defining types and kinds of events) or to play with it, even cheat it—which is perfectly possible. Hence, the module may be applied in three different ways:

(i) as a universal measurement and analysis device for objective data;

(ii) as a dialog partner for treatment of personal events;

(iii) for playing games.

The task routine ADDICT is a typical example for applications (ii) and (iii) and can be considered the standard form of the "May-I" game, either executed with serious intentions or for entertainment.

In the "May-I" game, for both purposes, essentially only one rule has to be strictly observed: follow the sequence: ASK--WAIT FOR YES--ACT. The corresponding keyboard dialog is: ENT--TRUE, then wait for a reply from K-DISPL, then S1(U), where U is set to the smoking series $T_{sm}$ in this example. Any infringment of this rule is easily detected by the module, because a bit in the interrogating series $T_{qu}$ can be set according to permission (YES) or veto (NO) of the inquiry (recall that each entry of the $T_{qu}$ series is stored in 3 bytes, the number of seconds/day is \$15018, hence, ½0 byte is free for flagging). In terms of time-marks, a transgression is set, if the last entry in the $T_{qu}$ series has a NO-bit and precedes the last entry of the smoking series $T_{sm}$. By analysis of the flag in $T_{qu}$, the number of infringements/day ($N_{ex}$) can, for example, be determined and be used for steering the program. A "May-I" request is, by the way, easily recognized by e.g., again reading the contents of IRA and SAFE (see flow chart in FIG. 6). The port input register IRA is latched with the help of the ACR-register in VIA 3.

Beforehand, the event-module ignores how to deal with the user's habit most effectively. Hence, the routine ADDICT consists of three distinctive sections: an observation phase (1) in which the smoking habit is recorded unconditionally, a strategy phase (2) in which the module decides on the further proceeding of therapy and an application phase (3) in which interactive treatment is performed and changes of strategies are possible. Actually, the module learns in all three phases: in phase (1), by observation; in the other two phases, by dialog with the user.

In the present example, three strategies (A,B,C) are built into the module

| | |
|---|---|
| ($N_{max}$: | daily smoking limit of cigarettes, e.g., $N_{max} = 32$, |
| $N_{SM}$: | current entry in smoking series $T_{sm}$): |
| strategy (A) permission for smoking, if | |
| (α) | $N_{sm} < N_{max}$ |
| (β) | $T_{qu}$ (last) − $T_{sm}$ (last) > $(\Delta T_e)_1$: abstinence interval |
| (γ) | $T_{qu}$ (last) − $T_{ir}$ (last) < $(\Delta T_e)_2$: irritation interval |
| (δ) | $T_{qu}$ (last) − $T_{qu}$ (last-2) < $(\Delta T_e)_3$: impatience interval |

In this strategy, the smoker may input his state of irritation (.e.g., withdrawal symptoms, etc.) into a $T_{ir}$ (e.g., type=\$A) series. Condition (δ) allows for the smoker's impatience. The YES-bit in the current entry $T_{qu}$ of the "May-I" request is set, if (α) and (β) or (γ) or (δ) are true. $(\Delta T_e)_1$: e.g., ¾ hour; $(\Delta T_e)_2$: e.g., ½ hour; $(\Delta T_3)_3$: e.g., 5 minutes. It is to be noted that this strategy can be accomplished by simple manual programming of the module via instruction 18, because $N_{max}=32$ corresponds to $(\Delta T_3)_1$ and the three boundary values can be input via instruction 15. Condition (δ) can be checked by the smoker, if he uses instruction 8 after each input of the "May-I" question (instruction 16). Hence, a smoker can fight his habit also *without* calling ADDICT which is another proof of the versatility of the module.

| | |
|---|---|
| strategy (B) permission for smoking, if | |
| (α) | $N_{sm} < N_{max}$ and if |
| (β) | 10 minutes have elapsed without smoking since the last "May-I" question. |

Actually, this strategy corresponds to a very serious recommendation of medical doctors.

| | |
|---|---|
| strategy (C) permission for smoking, if | |
| (α) | $N_{sm} < N_{max}$ and |
| (β) | YES-bit in the current entry of the "May-I" series $T_{qu}$ is set according to a random probability distribution. |

Strategy C is, of course, possible by use of a software or hardware random generator.

Figure 8:
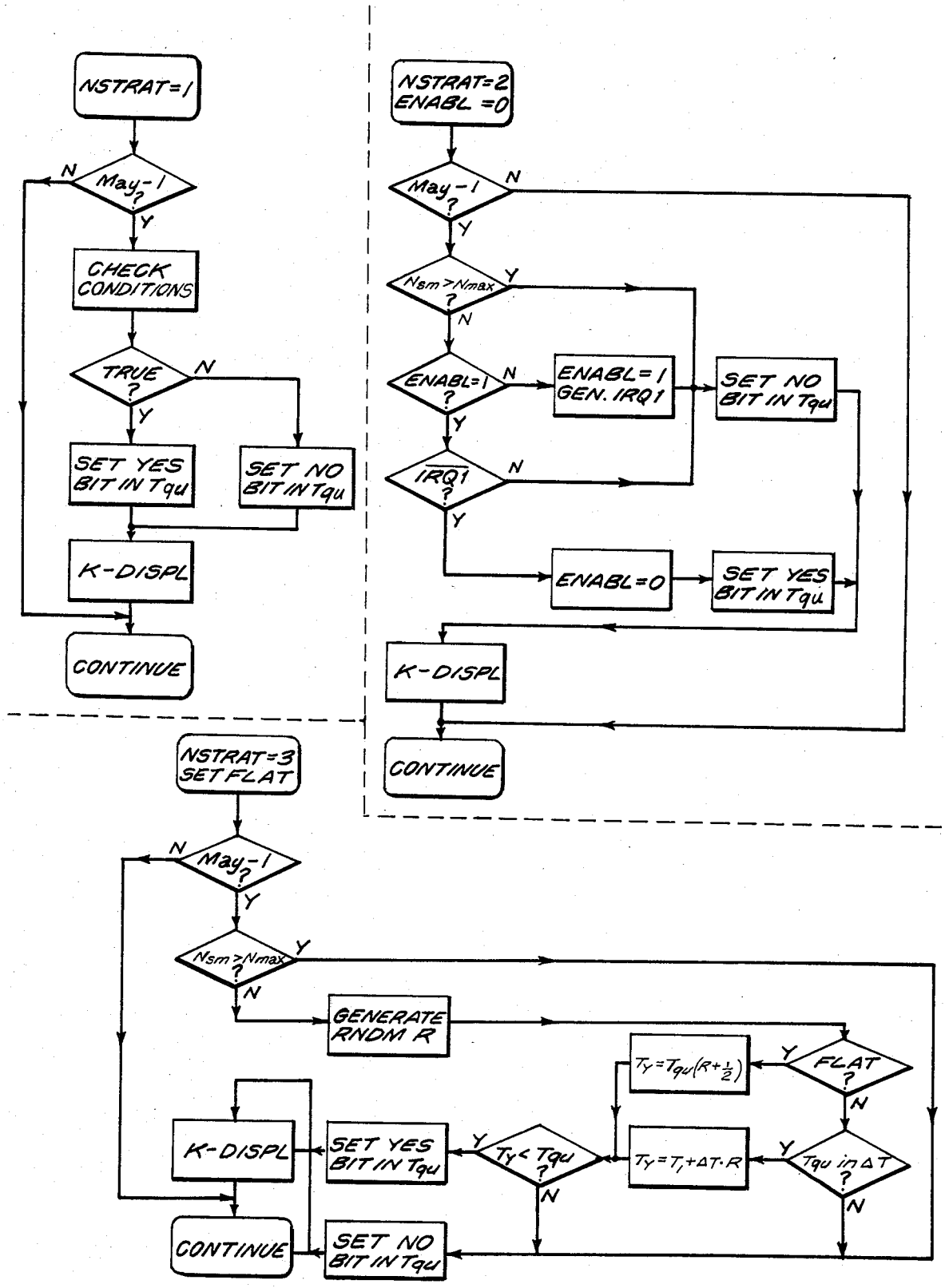

The flow charts of these strategy programs are shown in FIG. 8. Strategy A is very straightforward and need not be commented on. The YES/NO bit in the "May-I" series $T_{qu}$ is set according to the results of the checking. Strategy B involves the generation of an interrupt to occur 10 minutes after the "May-I" request (e.g., by use of the timers T1 and T2 in FIG. 3) and is steered by the software flag ENABL. Only after the occurrence of IRQ1 and ENABL=1 is the YES bit set in the last entry of $T_{qu}$ (for infringement checking) and the GREEN light is given on the K-DISPL. Requests during the 10 min. interval are inhibited. The random strategy C was chosen to allow either a 50% chance to get YES, if $N_{sm}<N_{max}$ (FLAT=1) or to give permission only, if $T_{qu}$ is between $T_1$ and $T_2$. These time limits are derived from mean $<T>_{sm}$ and variance $\sigma^2_{sm}$ of the summed smoking series obtained in the observation phase and are given by: $T_{1,2}=<T>_{sm}\pm\sigma_{sm}$. In the latter case, a GREEN light condition is generated which increases from zero to one with increasing "May-I" arrival-time. Such a strategy is quite useful, because any smoker who wants to fight his habit cannot exhaust the number of permitted cigarettes early in the day, in contrast to strategies A and B where frequently asking the "May-I" question also frequently gives permission, providing $N_{sm}<N_{max}$. The random generation of "YES" can equally simply be made to peak at $<T>_{sm}$ or to have a peculiar shape adapted to the user habit.

The general flow chart of ADDICT is displayed in FIG. 7. The boundary values $(\Delta T_e)_{1,2,3}$ can be set either by the user himself or by the program's options. In the present example, the maximum number of permitted cigarettes ($N_{max}$) is chosen to be $2^5=32$, corresponding to $(\Delta T_3)\frac{3}{4}h$. The observation phase (1) takes four days in which statistics on the smoking habit is collected. Each of the four series $T_{sm}$ (day 1–4) is fully kept in RAM and up to 100 entries/day are allowed (i.e., 1200 bytes in total). No restrictions are imposed on the smoker. Mean and variance of the summed distributions are evaluated.

In the subsequent strategy phase (2) which lasts 12 days (4 days/strategy A,B,C), the response of the user to the different learning approaches is tested. From now on, after one day's data taking, a reduction of the whole event series is performed in order to save memory space. For example, at midnight of the $i^{th}$ day, 28 bytes of data words are stored: $N_{sm}$, $N_{ex}$, $N_{ir}$, $N_{qu}$, $<T>_{sm}$, $\sigma^2_{sm}$, $<T>_{ex}$, $\sigma^2_{ex}$, $<T>_{ir}$, $\sigma^2_{ir}$, $<T>_{qu}$, $\sigma^2_{qu}$. The respective series are reset. It is to be noted that in this phase the particular strategy may change from day to day to minimize any possible bias.

A detailed analysis of this data buffer (after 12 days) allows one to compare the three strategies for their effectiveness. For determining the "best" strategy, the following three criteria may be used:

(a) absolute rating: $N^{1-4}_{sm}<4\cdot N_{max}$?

(b) relative improvement: $(N^3_{sm}+N^4_{sm})<(N^1_{sm}+N^2_{sm})$?

(c) decrease of infringements: $(N^3_{ex}+N^4_{ex})<(N^1_{ex}+N^2_{ex})$?

The indices $^1$, $^2$, $^3$, $^4$ denote the respective days of treatment.

In phase (3), the actual addiction therapy starts with the previously determined "optimum" strategy for the user. The strategy is maintained unchanged during at least another four days, $N_{max}$ is divided by 2 each day ($N_{max}=16,8,4,2$), data reduction is performed and the reduced data are added to the buffer. The data are analyzed according to the criteria listed above, progress may be signalled via K-DISPL (e.g., FOUL, GOOD, BAD . . . ) and the therapy run or "May-I" game is terminated, if e.g., $N_{sm}<5$. A willing user can obtain this result after 17 days in this example, and an appropriate acoustical applause can be given.

Additional valuable information on the user's mentality is obtained by daily changing *one* single parameter in the following runs (NLOOP=2,3; each therapy run lasts, e.g., 4 days), namely $N_{max}$, and by comparing the reactions of the user with the proposed reduction plan (infringements, relapses, etc.). $N_{max}$ may be decreased linearly instead of geometrically, or even at random.

If the desired progress is not achieved, the module already knows enough from the user (e.g., his impatience, his willingness to cooperate, his "I don't care" attitude, etc.) in order to change the criteria of the present strategy accordingly (e.g., the shape of the random probability for giving "YES"). In a second try, this modified strategy is applied for another four days. If success is not obtained, the program switches to the "next best" strategy (NSTRAT=NSTRAT+1) and so on.

If all efforts are in vain (after about 3 months), the therapy stops and this particular "May-I" game is over. The final failure may be displayed by a "four letter word" on the 8 digits of the K-DISPL.

At the end of the therapy (or "May-I" game) the REQUEST-CLOSED flag in the instruction list is set and the various event buffers and flags in PAM are cleared. Then the task routine ADDICT can be restarted from scratch. It is, however, imaginable that the routine keeps some reduced data from the previous runs in a special buffer. If ADDICT is called via ENT (m times, m≠n)--AUTO, the routine may use this reduced data for setting up the initial strategies.

These possibilities and many other refinements have not been considered in the present example and would rather obscure than elucidate the basic potential immanent in the proposed invention.

The "Strategy" or "May-I" game

In this section, is is explicitly demonstrated that entertaining and interesting games can be played with the event-module. No modification in the hardware architecture (FIG. 3) is needed and only minimum changes in software are necessary (e.g., allocation of memory space).

In the description of the task routine ADDICT, several strategies with learning potential had been outlined, with which an event-module can operate to *help* the user. Likewise, the module can be programmed to *oppose* the user, for example, in the "strategy" game which is given here.

In the "strategy" game, the player presses a push-button (say S1) as often as possible during a given time interval (say ½ hour). This action alone is certainly not entertaining. But suppose now that there is another push-button (say S2) which has to be activated conditionally in correlation with S1 in order to enable an increase of the user's score. If the player does not know beforehand the exact correlation strategy of the module, it is absolutely indispensable for him to recognize the latter, act according to it and exploit it fully. Hence, an intelligent match between module and player can be set up.

The essence of the "strategy" game is that the player tries to maximize his score in a given time limit by divining the counter-strategies of the module. In the subroutine STRAT, the entries $T_i$, $\Delta T_i$ of a given series, say type F, which are filled by pressing S1 and S2 are used for the game. $\Delta T_i$ is reconverted into absolute time and interpreted as "May-I" question $T_{qu}$. Only the first entry of $T_{qu}$ is used. The $(T_i;F)$ series is allocated sufficient space in the RAM field to keep up to, for example, 1800 entries (≙5400 bytes) and is interpreted as scoring series $T_{sc}$. The game starts by pressing, for example, ENT(2)--AUTO, thereby calling STRAT. In order not to divert the player by other display or warning actions of the module (recall that as many as 9 RT programs can run simultaneously in this example), all other activities of the module may be suspended by saving the REQUEST-OPEN tasks in the instruction list and then clearing it except for STRAT. At the beginning of the game, the initial score $N_{sc}=0$, $T_{qu}=\$FFFFFF$ and the $T_{sc}$ series is cleared. At the end of the game (e.g., after 1800 sec.), the instruction list may be restored.

The module counteracts the player's intention to increase his score $N_{sc}$ by employing e.g. the following six strategies in order to make life hard for the player. Scoring is only increased by one if (definition of YES condition):

(1) strategy A: pressing S2--S1 *and* no scoring during preceding 5 seconds;
(2) strategy B: pressing S2--WAIT 5 SECONDS--S1;
(3) strategy C: pressing S1 only, but YES is given between times $T_1$ and $T_2$ with randomly increasing probability $P_{sc}$;
(4) strategy D: same as C, except that $P_{sc}$ decreases with time;
(5) strategy E: same as C, except that $P_{sc}$ peaks at $T_M=0.5\ (T_1+T_2)$;
(6) strategy F: random choice of strategies A–E and switching to another strategy, as soon as player's success is recognized by the module.

Success of the player is defined e.g. by the criteria:

strategy A,B: 10 consecutive scorings
strategy C–E: total number of successful scorings ($N_{sc}=N_{sc}+1$) exceeds the total number of failures ($N_{sc}=N_{sc}-1$) by 5 in the time interval where $P_{sc}>0.5$.

Note that strategies A–E are simplified versions of strategies A–C in ADDICT (FIG. 8). If, in any strategy phase, the YES condition is not fulfilled (user error or ignorance), the NO bit is set in the $T_{sc}$ series (compare description of ADDICT) and $N_{sc}$ is decreased by one. The current score and the current YES/NO condition is, of course, always displayed on the K-DISPL in order to inform the player of his progress in understanding the counter-strategy presently adopted by the module. During each strategy phase, the $T_{sc}$ series including the YES/NO bit is incremented according to compliance or non-compliance with the prescriptions. $T_{qu}$ is reset to $FFFFFF before return, hereby overwriting the last "May-I" question. The reason for this procedure is clear from the internal realization of the strategies A–E in the module, given in the following: A YES bit in the current $T_{sc}$ entry is only set, if in

| | |
|---|---|
| (1) strategy A: | $T_{sc} > T_{qu}$ and $T_{sc} - T_{sc}$ (last Y) > 5 sec. |
| (2) strategy B: | $T_{sc} > T_{qu}$ and $T_{sc} - T_{sc}$ (last Y or N) > 5 sec. |
| (3) strategy C: | $T_{sc} > T_y = T_1 + (T_2 - T_1) \cdot R$ (R = random number) |
| (4) strategy D: | $T_{sc} \leqq T_y = T_1 + (T_2 - T_1) \cdot R$ |
| (5) strategy E: | $T_{sc} > T_y = T_1 + (T_M - T_1) \cdot R$ and $T_{sc} < T_M$ or $T_{sc} \leqq T_y = T_M + (T_2 - T_M) \cdot R$ and $T_{sc} \geqq T_M$ |

Course of game

After START, the module orders the strategies A–E in a random fashion and applies each one for max. 5 minutes. If S1 (S2) are correctly pressed, $N_{sc}=N_{sc}+1$, otherwise $N_{sc}=N_{sc}-1$ and YES/NO bit set in $T_{sc}$ series.

If a success of the player according to the above given success criteria is recognized by the module, a BONUS=300−no. of seconds is given and the next counter-strategy is chosen, again for max. 5 mins.. After, at most 25 minutes, the really difficult phase begins: strategy F (duration: max. 5 minutes). Now a BONUS=1000−no. of seconds is given after recognition of success and another strategy A–E is adopted at random (hence the same strategy may be repeated). After changing the strategy five times, the game is over and can last at most for 30 minutes. Overflow conditions are eliminated by truncation. The final score $N_{sc}$ ($N_{sc}=0$, if negative) and the duration of the game in seconds are displayed on the K-DISPL (e.g., 9876:1799). For "off-line" analysis, the $T_{sc}$ series may be interrogated by the player. If several players play the "strategy" game, the winner is determined from the maximum score in minimum time.

This is the basic concept of the "strategy" game and shows again the "psychotronic" features of the event-module. Since the flow chart of the complicated task routine ADDICT was shown in FIGS. 7–8, a flow chart of STRAT need not be given, because the latter is much less elaborate.

The "strategy" game can, of course, be refined in many ways, by, for example:

(i) employing more sophisticated counter-strategies;
(ii) allowing for multiple pressing conditions or inclusion of more keys;
(iii) also varying the boundary conditions at random (e.g., 5 sec.);
(iv) including more intermediate dialog (e.g., help).

But, these refinements can be left to the manufacturer of the module.

SCENARIO

After the preceding very detailed technical explanations related to the hardware and software structure of the event-module, it seems to be appropriate to demonstrate the versatility of the device in an actual scenario.

Recall firstly that all task routines—irrespectively whether they use objective or "psychotronic" data—are real time programs which can run simultaneously and with different priorities. The number of actually implemented task routines depends only on the manufacturer's intention and requires, of course, optimization of memory space in EPROM and RAM. Recall also that in the present example 16 types of event series, each consisting of 4 kinds, are at the user's disposal.

Now imagine that an addict (smoker, alcoholic, excessive eater etc.) undergoes a therapy. The medical doctor may even *prescribe* to use the event-module as a therapy support. Hence, the patient calls "ADDICT" and tries to fight his habit.

Imagine further that the patient is solitary, feels bored or wants to divert his thoughts from his "vice". So he might recourse to entertainment and calls "STRAT", i.e. he plays the "strategy" game during therapy.

Imagine further that the patient watches a skiing race at television and wants to follow quantitatively and reproducably the course of the race. So he enters times and durations for the skiers into the module. Perhaps he includes some boundary values also (e.g. time-table, world record ratings etc.).

Imagine finally that the patient observes a multitude of chores which he has manually communicated to the programmable module (e.g. observation of appointments, dates for gymnastics, pill-intake, frequency of medication etc.).

All this—and a lot more—can be performed in one go with the event-module. In fact, the scope of the module might even exceed the mental capabilities of the user and might confuse him occasionally. But this can be remedied by the variety of instructions offered to the user.

While the foregoing description and drawings represent the preferred embodiments of the present invention, it will be obvious to those skilled in the art that various changes and modifications may be made therein without departing from the true spirit and scope of the present invention.

TABLE 1

Summary of comparisons in objective series of times and durations and correspondence with comparisons of subjective series of events (personalized data)

| comparison type | logical test | objective comparison | subjective question | personal significance |
|---|---|---|---|---|
| 1 | $T_N - T_e^k \quad \Delta T_e^j$ | expected absolute time $T_e$ (entry k) with instant $T_N$ in expected time interval $\Delta T_e$ (entry j) | is it too early, too late? | inquiry for anticipated dates (e.g. preparation for a voyage or examination) |
| 2 | $T_N - T_i^k \quad \Delta T_e^j$ | occurred absolute time $T_i$ (entry k) with instant $T_N$ within expected lapse $\Delta T_e$ (entry j) | how much time has passed,since . . . ? did it happen? | inquiry for passed events or for non-occurrence of an event (e.g. watch-man) |
| 3 | $T_i^k - T_i^l \quad \Delta T_e^j$ | occurred absolute time $T_i$ (entry k) with occured $T_i$ (entry l) within expected lapse $\Delta T_e$ (entry j) | how often, how rarely, not at all, since . . . ? | frequency of occurred events (e.g. therapy) |
| 4 | $T_i^k - T_e^l \quad \Delta T_e^j$ | expected absolute time $T_e$ (entry l) with occurred absolute time $T_i$ (entry k) within expected time interval $\Delta T_e$ (entry j) | has something happened earlier, later than expected or not at all? | correlation of own experiences with plan (e.g. appointments or time-table) |
| 5 | $\Delta T_i^k \quad \Delta T_e^j$ | occurred duration $\Delta T_i$ (entry k) with expected duration $\Delta T_e$ (entry j) | did something take too long or too short? | correlation of occurred duration with expectations (e.g. sports) |
| 6 | $\Delta T_i^k \quad \Delta T_i^j$ | occurred duration $\Delta T_i$ (entry k) with occurred duration $\Delta T_i$ (entry j) | did something take longer or shorter? | correlation of occurred durations among each others (e.g. fitness check) |

Comments:
For simplicity, the type U of data or event has not been entered explicitly into the table. It is however, obvious that all these comparisons can be made also among events or data of different kind and type. This feature in the event-module adds another degree of freedom. Comparisons of expectations among each others are not listed, because they are usually know beforehand.

TABLE 2

System components and manufacturers

| chip | manufacturer |
|---|---|
| SY 6502 (CPU) | Rockwell, Synertek |
| 2764 (64K EPROM) | INTEL |
| TC 5565 (64K RAM) | Toshiba |
| SY 6522 (VIA) | Rockwell, Synertek |
| MSM 5832 (RT-clock) | OKI |
| EA 3102, EA 3105-B (LCD) | DATA MODUL |
| Hexa switches | Spoerle |
| 74LS138 (Decoder) | Texas Instr. |

TABLE 2-continued

System components and manufacturers

| chip | manufacturer |
|---|---|
| 74LS148 (Encoder) | Texas Instr. |
| 74LS157 (Multiplexer) | Texas Instr. |
| 74LS74 (Flip-Flop) | Texas Instr. |
| 74LS123 (Mono-Flop) | Texas Instr. |
| 74LS00 (QUAD-NAND) | Texas Instr. |
| 74LS86 (Exclusive-OR) | Texas Instr. |

Comment:
All components for the event-module are available in CMOS technology (e.g. CPU: 14685 (MOTOROLA), VIA: 6521 (Rockwell) or 146823 (MOTOROLA) EPROM: 27C64 (INTEL) or TC5365 P (Toshiba), Mono-Flop: MC 14538 (MOTOROLA) etc.).

TABLE 3

Memory configuration of the event-module

| dec. loc. | contents | hexa-addr. | |
|---|---|---|---|
| 0 | PortA, PortB data, data dir. reg's<br>Timer data, Timer control<br>----------<br>---------- | $ 0 | 8K RAM |
| 511 | STACK (max. 128 bytes) | $ 1FF | |
| 512 | $T_N$, $T_N'$, $T_R$, $T_{CD}$<br>Current instruction, current task<br>Pointers, Flags for decoding and storing in data fields ; Counters<br>Abs. field addresses and word counters<br>Decoded IRQ's and NMI's<br>Variable instruction list<br>---------- | $ 200 | |
| 1023 | ---------- | $ 3FF | |
| 1024 | Data fields ($T_i$,$\Delta T_i$,$T_e$,$\Delta T_e$),type U; $T_{qu}$;<br>(each series e.g. 64 entries, 3 bytes/event)<br>---------- | $ 400 | |
| | Copy space | | |
| 8191 | | $1FFF | |
| 32768 | VAI 1-- VIA 3 addresses and sub-addr. | $8000 | |
| 32815 | | $802F | |
| 57344 | Start address of monitor<br>---------- Task routines | $E000 | 8K EPROM |
| 65530,1 | NMI-Vector | $FFFA,B | |
| 65532,3 | RESET-Vector | $FFFC,D | |

TABLE 3-continued

| Memory configuration of the event-module | | |
|---|---|---|
| dec. loc. | contents | hexa-addr. |
| 65534,5 | IRQ-Vector | $FFFE,F |

Comment:
The RAM locations $0–$1FFF and the EPROM addresses $E000–$FFFF are not fully specified, because the actual layout depends very much on the specific application of the event-module.

TABLE 4

| Basic key board instructions number of pressings indicated in parenthesis | | | |
|---|---|---|---|
| Nr. | INSTRUCTION | SIGNIFICANCE | |
| (1) | CL(1)- -$T_N$ | clears interrrogating series $T_{qu}$ | |
| (2) | CL(2)- -$T_N$ | clears instructicn list | |
| (3) | CL(3)- -$T_N$ | general RESET; restart in watch mode | |
| (4) | CLS(1)- -$T_N$ | resets K-DISPL or alarm | (K1) |
| (5) | CLS(2)- -$T_N$ | displays last entries of $T_{qu}$, ($T_i$;U) | (K2) |
| (6) | CLS(3)- -$T_N$ | displays requests in instruction list | (K3) |
| (7) | DSP(1)- -$T_N$ | exchanges $T_N$- - -$T_R$- - -$T_{CD}$ | (T1) |
| (8) | DSP(2)- -$T_N$ | displays last times of $T_{qu}$, ($T_i$;U) | (T2) |
| (9) | DSP(3)- -$T_N$ | displays fully last instructicn | (K7) |
| (10) | $SET_E$(1)- -S3- -$T_N$ | sets $T_N$ via synchronization | (T3) |
| (11) | $SET_E$(2)- -S3- -$T_N$ | sets $T_R$ or TCD via synchronization | (T3) |
| (12) | CL(1)- -Op | clears series Op(U) completely | |
| (13) | CLS(n)- -Op | clears $n^{th}$ entry in Op(U) | |
| (14) | DSP(n)- -Op | displays (Op(n);U) | (T4) |
| (15) | $SET_E$(n)- -S3- -Op | sets {$T_e$, $\Delta T_e$}(n;U) via synchronization | (T3) |
| (16) | ENT(1)- -TRUE | stores next $T_{qu}$ (May-I question) | |
| (17) | ENT(n- -AUTO | executes $n^{th}$ task routine | (K6) |
| (18) | ENT(n)- -Op- -JMP- -TRUE | executes manual comparison program; results in immediate Y/N display | (K4) |
| (19) | LNT(n)- -Op- -JMP- -AUTO | executes manual comparison program; results in Y display, when condition materializes | (K5) |
| | Furthermore, data definition and data input is given by: | | |
| (20) | S1(U) | stores $T_N$ in next free cell of (Ti;U) | |
| (21) | S2(U) | computes difference: $T_N - (T_i;U)_{last}$ and stores it into $(\Delta T_i;U)_{last}$ | |
| (22) | S3 | controls synchronization in position 1–14 | |
| (23) | U | defines event type U (position 0–15) | |

Comment:
The display types K1,,K7 (K-DISPL) and T1,,T4 (T-DISPL) are shown in table 5.

TABLE 5

| Digit information in various display modes (K-DISPL, T-DISPL) | | | | | | | | |
|---|---|---|---|---|---|---|---|---|
| Display Type | dig1 | dig2 | dig3 | dig4 | dig5 | dig6 | dig7 | dig8 |
| K1 | O | O | O | O | O | O | O | O |
| K2 | $J_{last}(T_{qu})$ | | $K_{last}(T_i;U)$ | | #YES bits($T_{qu}$) | | #YES bits($T_i$) | |
| K3 | #OPEN-REQ. | | #CLOSED-REQ. | | #MISSED-REQ. | | (QN, CT)$_{last}$ | |
| K4 | QN | | CT | | $U_1$ | $U_2$ | $U_3$ | YES/NO |
| K5 | QN | | CT | | $U_1$ | $U_2$ | $U_3$ | YES |
| K6 | M | E | S | S | A | G | E | S |
| K7 | #ENT | Op1 | #ENT | Op2 | #ENT | Op3 | JMP | A/T |
| T1 | DAY | DAY | HOUR | HOUR | MIN. | MIN. | SEC. | SEC. |
| T2 | $T_{qu}$ (HHMM)$_{last}$ | | | | $T_i$ (HHMM)$_{last}$ | | | |
| T3 | display of stepping digit of clock registers 1–13 (Hz) | | | | | | | |
| T4 | static display of Op(n;U); either in sec. or as in T1 | | | | | | | |

Comments
K2: $J_{last}(T_{qu})$, $K_{last}(T_i;U)$: #entries in respective series; #YES bits($T_{qu}$), #YES bits($T_i$): corresponding no. of flagging bits relevant for e.g. ADDICT, STRAT
K3: instruction list information on open or closed requests, missed alarms (K-DISPL reset by module after 10 min.) and QN, CT for most recent missed alarm
K4: $U_1$,$U_2$,$U_3$ are event type of Op($U_1$),Op($U_2$),Op($U_3$) involved in the
K5: comparison, recognized from TYP(K) vector (see DECODE); YES/NO coded as $E(enables=YES) or $F(forbidden=NO)
K6: MESSAGES symbolizes any message given in task routines
K7: Op1,Op2,Op3 coded as 1,,5 according to keys $T_N$,$T_i$, $\Delta T_i$,$T_e$,$\Delta T_e$; JMP coded as 1,2,3 according to JUMP( <, = , >); A/T coded as 2,1
T2: corresponds to K2 display and shows e.g. only hour (high/low) and min. (high/low) of last entry in the series $T_{qu}$, $T_i$;type U

What is claimed is:

1. A mobile electronic device for a general correlation analysis of codified series of occurred, missed and expected events which are defined by their type, time of occurrence and/or duration, comprising:

clock means for providing clock pulses representing real time;

synchronization means for updating said clock means;

switchable means for providing timing signals representing timed occurrences, timed durations, expected occurrences and expected lapses;

codification means for marking said timing signals;

computing means including read-only memory means and register means for executing predetermined programs operating on said timing signals and being steered by a monitor program, said computing means providing resultant output signals;

instruction means for providing instruction signals to said computing means for executing specific tasks;

multiplexer and encoder means for identifying said instruction means;

random-access memory means for storing said timing signals and said instruction signals and resulting output signals of said computing means;

input-output interface means for providing input signals to and for receiving output signals from said computing means and said memory means and said clock means and said instruction means;

timer, counter and latching means in said interface means responsive to signals from said instruction means and said computing means;

display means responsive to said interface means for displaying representations of output signals from said interface means;

whereby a programmable interactive dialog is permitted between the device and user of the device in which the flow of events (codified time-marks) is controlled and modified, and which allows real-time and off-line correlation analysis.

2. The device according to claim 1, wherein said synchronization means includes at least one synchronization switch for updating real time.

3. The device according to claim 2, wherein said switchable means includes at least one switch for input of signals representing time-marks of a certain kind.

4. The device according to claim 2, wherein said codifying means includes at least one coding switch for supplying event-type definition.

5. The device according to claim 2, wherein said display means includes at least one LCD display.

6. The device according to claim 2, wherein said display means includes an acoustical device.

7. The device according to claim 2, wherein said instruction means includes a keyboard.

8. The device according to claim 7, wherein said keyboard means with said synchronization means allows input of signals representing external time-marks of a certain kind.

9. The device according to claim 7, wherein said keyboard means allows input of a signal representing instants at which the device was interrogated.

10. The device according to claim 7, wherein the keyboard includes a plurality of keys which allows setting up of instructions which steer the monitor program, manipulate the data, control the I/O interface, interrogate the device and call specific task routines.

11. The keyboard according to claim 10, wherein the plurality of keys allows manual programming of comparisons of events from any series defined by type and kind in the most general way, wherein the device is faced to output the truth condition.

12. The device according to claim 10, wherein comparisons of events are made by the keyboard within a margin.

13. The device according to claim 10, wherein the device certifies the comparison condition and outputs the materialization of the programmed questions in the course of their occurrences.

14. The device according to claim 2, wherein the monitor program includes specific task routines such as: control, decoding of instructions, comparisons, building up of a variable instruction list, general correlation analyses, random generator and dialog.

15. The device according to claim 14, wherein the signals representing instants at which the device was interrogated are stored in the random-access memory as another event series which can be flagged according to the previous history of the event-flow.

16. The device according to claim 15, wherein event series pertinent to series of personal occurrences can also be flagged by said computing means.

17. The device according to claim 16, wherein therapy and game applications with built-in learning strategies based on the actual status of event and May-I-Series which are flagged can be executed which are capable of learning steps and teaching steps.

18. The device in accordance with any one of claims 2–17, wherein said computing means, random-access memory, read-only memory and input/output interface means are constructed using LSI technology and the device includes a housing in the form of a wrist or pocketwatch casing for containing the various portions of the device and for providing displays and alarms to the user.

* * * * *

UNITED STATES PATENT AND TRADEMARK OFFICE

CERTIFICATE OF CORRECTION

PATENT NO. : 4,518,267

DATED : May 21, 1985

INVENTOR(S) : Volker Hepp

It is certified that error appears in the above-identified patent and that said Letters Patent is hereby corrected as shown below:

Column 19, Table 1:

Under "logical test" 1: should read --$T_N - T_e^k \gtreqless \Delta T_e^j$--;

Under "logical test" 2: should read --$T_N - T_i^k \gtreqless \Delta T_e^j$--;

Under "logical test" 3: should read --$T_i^k - T_l^l \gtreqless \Delta T_e^j$--;

Under "logical test" 4: should read --$T_i^k - T_e^l \gtreqless \Delta T_e^j$--;

Under "logical test" 5: should read -- $\Delta T_i^k \gtreqless \Delta T_e^j$--;

Under "logical test" 6: should read -- $\Delta T_i^k \gtreqless \Delta T_i^j$--.

UNITED STATES PATENT AND TRADEMARK OFFICE

CERTIFICATE OF CORRECTION

PATENT NO. : 4,518,267

DATED : May 21, 1985

INVENTOR(S) : Volker Hepp

It is certified that error appears in the above-identified patent and that said Letters Patent is hereby corrected as shown below:

Column 21, Table 4:

Under "INSTRUCTION" (19): should read --ENT(n)--Op--JMP--AUTO--.

Signed and Sealed this

*Third* Day of *December 1985*

[SEAL]

*Attest:*

DONALD J. QUIGG

*Attesting Officer*

*Commissioner of Patents and Trademarks*